United States Patent [19]

Suvanto

[11] Patent Number: 4,566,302

[45] Date of Patent: Jan. 28, 1986

[54] TREATMENT PRIOR TO DISPOSAL OF A SHEATHING TUBE OF A SPENT FUEL BOX OF A NUCLEAR REACTOR FUEL ASSEMBLY

[75] Inventor: Antti Suvanto, Västerås, Sweden

[73] Assignee: AB Asea-Atom, Västerås, Sweden

[21] Appl. No.: 440,945

[22] Filed: Nov. 12, 1982

[30] Foreign Application Priority Data

Sep. 20, 1982 [SE] Sweden ..... 8205362

[51] Int. Cl.[4] ..... B21C 47/14

[52] U.S. Cl. ..... 72/146; 241/232; 252/626

[58] Field of Search ..... 72/146, 148, 182; 100/170, 176; 241/37, 231, 232; 252/626, 627

[56] References Cited

U.S. PATENT DOCUMENTS 3,038,521 6/1962 Wagner ..... 720/146

4,154,408 5/1979 Boling, Jr. ..... 241/231

*Primary Examiner*—Mark Rosenbaum

*Attorney, Agent, or Firm*—Watson, Cole, Grindle & Watson

[57] ABSTRACT

A method of treating a sheathing tube or fuel channel of a spent fuel box of a fuel assembly of a nuclear reactor comprises containing and reducing the volume of the sheathing tube prior to its disposal. The sheathing tube, after separation from a bottom piece of the fuel box, is placed in a protective tube. The protective tube and sheathing tube contained therein are then flattened and shaped into a convoluted form. Typically the flattening and shaping are performed in a single operation in a rolling mill, the protective tube and sheathing tube being rolled into a coil.

4 Claims, 9 Drawing Figures

TREATMENT PRIOR TO DISPOSAL OF A SHEATHING TUBE OF A SPENT FUEL BOX OF A NUCLEAR REACTOR FUEL ASSEMBLY

This application is a divisional application of application Ser. No. 440,945, filed Nov. 12, 1982.

BACKGROUND OF THE INVENTION

This invention relates to a method of treating a sheathing tube of a spent fuel box of a fuel assembly of a nuclear reactor prior to disposal. The invention also relates to a rolling mill used in carrying out the treatment.

In a nuclear power reactor of the boiling or pressurized water reactor type, a reactor core is constructed from a large number of fuel assemblies, which at the bottom rest on a lower grid of supporting plates and at the top are fixed to a core grid. Each fuel assembly comprises a number of fuel rods, which are placed in a fuel box. The fuel box consists of a sheathing tube or fuel channel of, for example, a zirconium alloy, and a bottom piece at the lower end of the fuel channel. This bottom piece extends down into openings in the supporting plates. The bottom piece constitutes an inlet for cooling water and the sheathing tube constitutes a guide tube for control of the flow of cooling water around the fuel rods.

The fuel box is not consumed when in use in the nuclear reactor but it has a relatively limited life because deformation occurs due to relaxation, corrosion and ageing. Because the sheathing tube (or fuel channel) during use is subjected to intensive neutron radiation, ageing and brittling are accelerated and certain alloying materials included in the sheathing tube are converted into unstable isotopes which, when disintegrating, give off radioactive radiation for a long period of time. Further, radioactive products are deposited on the tube surfaces. These facts, together with relaxation, corrosion and ageing, mean that the reuse of the tube material involves a problem from the point of view of radiation and is technically unsuitable. Therefore, non-usable spent fuel boxes are deposited in waste plants.

Since fuel boxes have a relatively large volume, it is important to reduce their volume prior to disposal. One way to reduce the volume of the fuel box has been to remove the bottom piece therefrom and to thereafter divide the substantially square section sheathing tube diagonally to obtain two elongated, angle-shaped members. This division by splitting the sheathing tube in two along its length may, however give rise to chipping and scattering of fine radioactive particles. Also, during use the irradiation of the sheathing tube causes the tube material, particularly at the midportion of the tube, to become so brittle that the tube may break during the splitting operation, rendering its management or control very difficult. Packages of divided sheathing tubes are contained in casings prior to their disposal.

The present invention aims to provide a decrease in volume prior to the disposal of sheathing tubes of fuel boxes in a manner which is more favourable than hitherto used methods both from the point of view of handling, protection and economy. A considerable advantage of the invention is that in the event of rupture of the sheathing tube, the spreading of tube parts and fine-grained depositions on the tube surfaces can be completely prevented in a simple manner.

SUMMARY OF THE INVENTION

According to the invention, a method of treating a sheathing tube of a spent fuel box of a nuclear reactor fuel assembly prior to disposal comprises placing the sheathing tube in a protective tube, flattening the protective tube and sheathing tube contained therein and shaping the flattened protective tube and the sheathing tube contained therein to a convoluted form.

The convoluted form may be a coil formed by winding the tubes around a mandrel or a roll. Alternatively, the convoluted form may be a package of parallelepipedal shape, formed by folding and compressing the tubes. The flattening step can be achieved by rolling. In this case the flattening and shaping steps are advantageously carried out in one operation by winding the tubes onto one of the rolls of a rolling mill.

It is important that the material used for the protective tube is tough and has great rupture strain. Stainless steel SIS 2333 (corresponding to ASTM A 167-70 TYPE 304 L) is a suitable material having a good rupture strain, i.e. higher than 50%. The protective tube may have the same shape as the sheathing tube, but from the point of view of cost it may be advantageous to use round protective tubes manufactured by helical welding of strip.

The treatment is suitably performed under a radiation-protecting water layer. Water which is pressed out during the flattening step may be filtered in a filtering plant e.g. a filter, which is connected to the orifice of the protective tube.

The sheathing tube generally has a rectangular cross-section and is preferably oriented in such a way that it will be flattened diagonally.

If the tubes are shaped into a coil, the centre of the coil is suitably made sufficiently large that the bottom piece from a fuel box can be placed inside the coil.

If a filter is inserted in the end of the protective tube it may, after flattening, constitute a sufficient seal. If not, however, sealing by welding is possible but difficult to perform under a radiation-protecting water layer.

If the tubes are flattened in a rolling mill, the lower end of the protective tube may first of all be flattened and be connected, e.g. welded, to a sleeve-formed gripping member with internal bars. The gripping member is then mounted on a driving roll of the rolling mill with the internal bars received in grooves of the driving roll. After shaping into a coil, the coil is provided with an end cap for preventing the coil from expanding by spring back. By providing a cylindrical portion of the end cap with an axial slot, so that the coil is only partially surrounded, the end cap may be fitted over the coil when the coil is in the rolling mill and be compressed between the cooperating rolls.

A rolling mill according to the invention comprises a driven roll with a driving or gripping member for connecting a protective tube to the roll, driving machinery for driving the driven roll and a press roll displaceable towards the driven roll. The latter press roll is arranged to be displaceable by means of a resilient force-generating pressure member which urges the press roll against the driven roll by a predetermined force, which is controlled by a regulating device. The driven roll may be provided with a groove, in which a flattened end of a protective tube may be clamped, or with a groove into which a bar in a sleeve, connected to the protective tube, may be pressed. The press roll may be pressed against the driven roll by means of an operating cylinder, which is connected to a pressure medium source by way of an operating and pressure regulating device. Suitably, a fluid is used as pressure medium.

BRIEF DESCRIPTION OF THE DRAWINGS

The invention will now be further described, by way of example with reference to the accompanying schematic drawings, in which.

DESCRIPTION OF THE PREFERRED EMBODIMENTS

Figure 1:
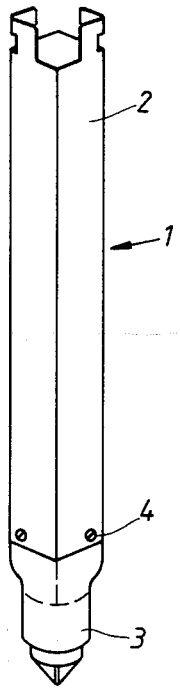
FIG. 1 is a perspective view of a fuel box comprising a sheathing tube and a bottom piece connected thereto.

In FIG. 1 there is shown a spent fuel box 1 of a fuel assembly of a nuclear reactor, the fuel box 1 consisting of a sheathing tube or fuel channel 2 of square cross-section and a bottom piece 3 assembled together into a unit by means of screws 4.

Figure 3:
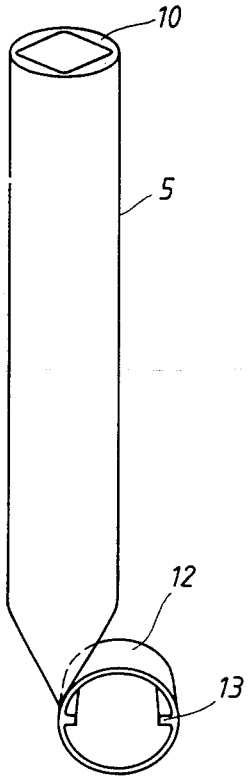
FIG. 3 is a perspective view of another embodiment of a protective tube connected to a sleeve for connection to a driven roll of a rolling mill.
Figure 4:
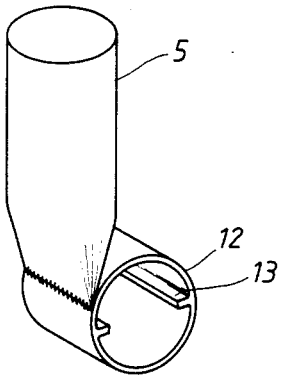
FIG. 4 is another view of the lower portion of the protective tube and the sleeve shown in FIG. 3, FIGS. 5 and 6 are a side view and a plan, respectively, of a rolling mill.

In order to treat the fuel box 1 prior to its disposal, the fuel channel 2 is separated from the bottom piece 3 and is inserted into a protective tube 5 (see FIGS. 2 to 4) of circular external cross-section and typically made of stainless steel. These operations are suitably performed under water which acts as a radiation-protecting layer. A filter 11 (see FIG. 2) is provided in the rear or upper end of the protective tube 5. The rear end of the tube 5 is also provided with a locking device 10 which permits insertion of the fuel channel 2 into the tube 5 but which after rotation of the fuel channel in the tube 5 prevents the fuel channel 2 from moving backwards in tube 5. The filter 11 suitably seals the end of the protective tube, although it may be necessary to further seal the end of the tube 5 by means of welding.

The protective tube 5 and fuel channel 2 are then flattened, e.g., in a rolling mill. As the tube 5 and fuel channel 2 are progressively flattened from their front or lower ends towards their upper or rear ends during rolling, water in the tube 5 is pressed or squeezed out through the filter thereby capturing any particles contained in the water.

Figure 8:
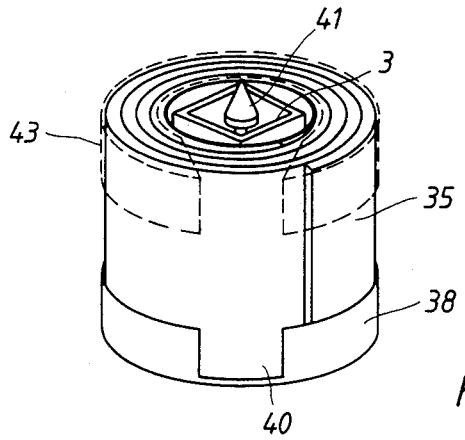
FIG. 8 is a perspective view of a flattened and coiled package of a sheathing tube contained in a protective tube with an end cap at either end and a bottom piece inserted in the middle.

In one method of treatment the front or lower end of the protective tube 5 is fixed to, or relative to, a driven roll of the rolling mill so that, as the tube 5 and fuel channel 2 are flattened in the rolling mill, they are also wrapped around the driven roll to form a package in the form of a coiled roll 35 (see FIG. 8).

Figure 2:
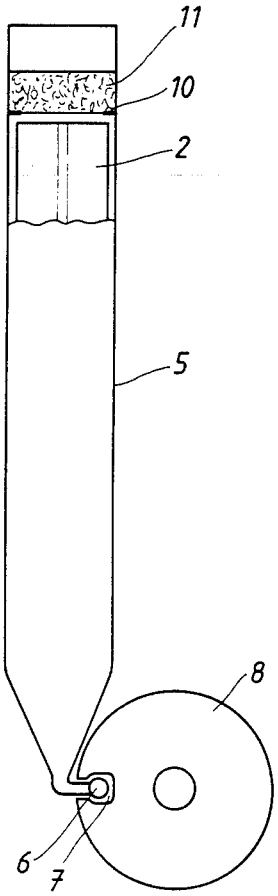
FIG. 2 is a side view of one embodiment of a protective tube connected to a driven roll of a rolling mill.

FIG. 2 shows one method in which the front end of the protective tube 5 is fixed to a driven roll 8 of a rolling mill. In particular the roll 8 has at least one groove 7 formed therein having a narrow neck portion opening into the circumferential surface of the roll 8 and an enlarged bottom portion. The front or lower end portion of the protective tube 5 is flattened, angularly bent and formed with a bead 6 for sliding reception in the enlarged bottom portion of the groove 7. The narrow neck portion of the groove 7 prevents the bead 6 being pulled out of the groove in a radial direction relative to the roll 8. Of course it will be appreciated that the protective tube 5 may be fixed to a driven roll of a rolling mill by other means, the method described with respect to FIG. 2 only being by way of example.

Instead of being fixed directly to driven roll of a rolling mill the protective tube 5 may be fixed to a sleeve 12 (see FIGS. 3 and 4) designed to be slid over and be driven by the driven roll of the rolling mill. In particular the front or lower end of the protective tube 5 is flattened and connected, e.g. welded, to the external surface of the sleeve 12. The sleeve 12 has engaging means, e.g. internal bars 13, which are designed to locate in grooves 17 (see FIG. 5) of a driven roll 16 when the sleeve 12 is slid into position over the roll 16.

Figure 5:
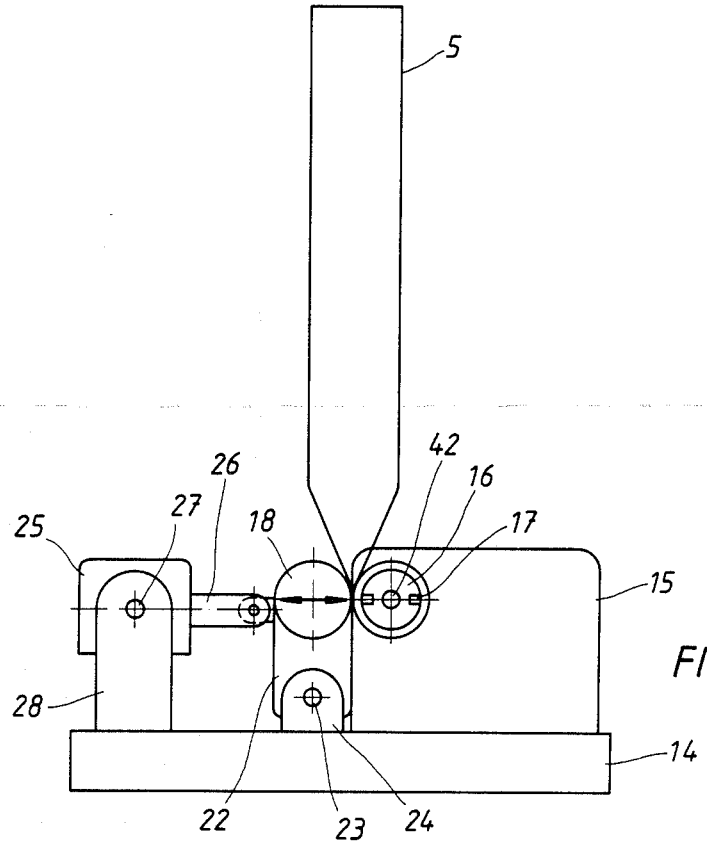
Figure 6:
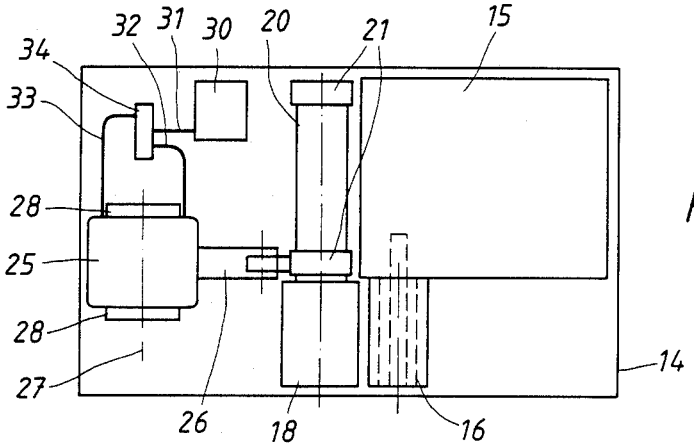

The rolling mill shown in FIGS. 5 and 6 for rolling and shaping the protective tube 5 and fuel channel 2 into the coiled roll 35 has a roll 16 with grooves 17 therein for locating the sleeve 12. However, it should be realized that the driven roll 16 could be replaced by the driven roll 8 shown in FIG. 2. The rolling mill further comprises a bottom plate 14 with driving machinery 15 which supports the winding-up driven roll 16. A press roll 18 is arranged for movement relative to the roll 16 and is supported by a shaft 20 which is journalled in bearings 21 in a stand 22. This stand 22 is rotatably journalled on a shaft 23, which is supported by brackets 24 on the bottom plate 14, to enable the stand to pivot about the axis of the shaft 23. The stand 22 with the roll 18 is operated so as to be urged against the roll 16 with a force which is sufficient for flat rolling of the protective tube 5 and the fuel channel 2 contained therein. The roll 18 is urged towards the roll 16 by a hydraulic cylinder 25 which is flexibly connected to the stand 22 by means of a piston rod 26. The cylinder 25 is rotatably journalled on a shaft 27 which is supported by brackets 28 on the bottom plate 14. The cylinder 25 is supplied with a pressure medium from a pressure medium source 30 via conduits 31, 32 and 33 and a valve 34. This valve 34 is of a type which permits the setting of a maximum pressure, which limits the force by which the press roll 18 is pressed against the protective tube 5 and the fuel channel 2 contained therein. As the diameter of the formed coil increases during the rolling and shaping, the press roll 18 moves away from the roll 16 whilst still pressing against the rolled coil being formed. As can be seen in FIG. 2, the fuel channel 2 is arranged in the protective tube 5 so that during rolling the square section fuel channel is flattened diagonally.

Figure 7:
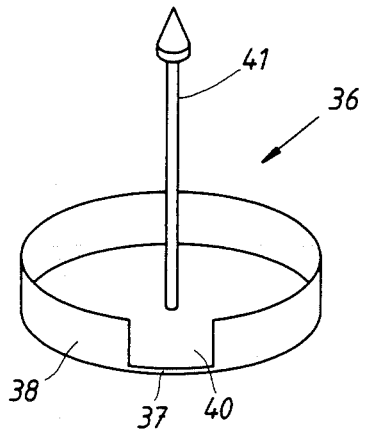
FIG. 7 is a perspective view of an end cap for placement over an end of a flattened and coiled package of a sheathing tube contained in a protective tube.

The rolling mill flattens and shapes the protective tube 5 and the fuel channel 2 contained therein into the rolled coil 35 (see FIG. 8). In order to prevent the rolled coil 35 from expanding because of spring back, an end cap or piece 36 (see FIG. 7) is applied to one end of the coil 35 before the press roll 18 is moved away out of contact with the rolled coil and the finished coil is removed from the roll 16. This end piece 36 may comprise an end cover portion 37 and a cylindrical flange 38 formed integrally therewith and having an opening 40 therein. The opening 40 permits the end piece 36 to be applied over an end of the coil 35 while the press roll 18 is still pressed against the coil 35. The end piece 36 may be provided with a lifting pin 41, which facilitates the handling of a coil. The roll 16 must then be provided with a bore 42 which permits insertion of the lifting pin into this roll. A bottom piece 3 may be positioned at the centre of the coil 35 as shown in FIG. 8. The coil 35 may also be provided with a second end piece 43, as indicated by dashed lines in FIG. 8. If this second end piece 43 is made in the form of a horseshoe, it can be mounted while the coil is still mounted on the roll 16.

Figure 9:
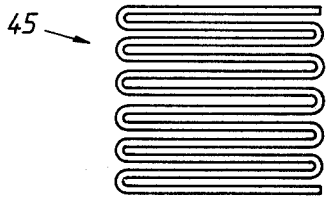
FIG. 9 is a side view of a substantially parallelepipedal package formed by folding a flattened protective tube and sheathing tube contained therein backwards and forwards.

Instead of flattening and shaping the protective tube 5 and fuel channel 2 into a convoluted form, e.g., a rolled coil, in a single operation, the tube 5 and fuel channel 2 may be shaped in a subsequent operation. Furthermore instead of being shaped into a rolled coil, the protective tube 5 and fuel channel 2 may be shaped into a different convoluted form. For example after flattening (e.g., between cooperating rolls of a rolling mill), the protective tube 5 and fuel channel 2 contained therein may be folded backwards and forwards through 180° to form a package 45 (see FIG. 9). The package may be compressed into a compact shape of substantially rectangular parallelepiped form as shown in FIG. 9.

The method of treatment outlined above may be varied or modified within the scope of the following claims.

What is claimed is:

1. An apparatus for flattening a tubular member which contains a spent fuel box of a nuclear fuel assembly, said tubular member including a lower end which includes a bead, said apparatus being usable beneath the surface of a tank of radiation-protecting water, said apparatus comprising a base plate, a first roll fixedly mounted in cantilever fashion on said base plate, said first roll including a groove in its circumferential surface for containing the bead at the lower end of the tubular member containing the spent fuel box, said groove extending longitudinally of said first roll, drive means connected to said first roll to rotate said first roll, a second roll mounted in cantilever fashion on said base plate, support means pivotally connected at its lower end to said second roll to enable said second roll to move toward and away from said first roll, and adjustment means connected to said support means to control the positioning of said second roll with respect to said first roll.

2. An apparatus as defined in claim 1, wherein said adjustment means includes a hydraulic operating means that includes a piston rod connected to said support means, and a supply system for supplying hydraulic fluid to said hydraulic operating means.

3. An apparatus for flattening a tubular member which contains a spent fuel box of a nuclear fuel assembly, said apparatus being useable beneath the surface of a tank of radiation-protecting water, said apparatus comprising a base plate, a first roll fixedly mounted in cantilever fashion on said base plate, said first roll including at least one groove in its circumferential surface which extends longitudinally thereof, a sleeve mounted around the circumference of said first roll, said sleeve including at least one inwardly extending bar for positioning in a respective groove in said first roll, said sleeve being connectable to the lower end of the tubular member, drive means connected to said first roll to rotate said first roll, a second roll mounted in cantilever fashion on said base plate, support means pivotally connected at its lower end to said second roll to enable said second roll to move toward and away from said first roll, and adjustment means connected to said support means to control the positioning of said second roll with respect to said first roll.

4. An apparatus as defined in claim 3, wherein said adjustment means includes a hydraulic operating means that includes a piston rod connected to said support means, and a supply system for supplying hydraulic fluid to said hydraulic operating means.

* * * * *